US010018088B2

(12) United States Patent
Eroglu

(10) Patent No.: US 10,018,088 B2
(45) Date of Patent: Jul. 10, 2018

(54) HELMHOLTZ DAMPER FOR GAS TURBINE WITH COOLING AIR FLOW

(71) Applicant: ANSALDO ENERGIA IP UK LIMITED, London (GB)

(72) Inventor: Adnan Eroglu, Untersiggenthal (CH)

(73) Assignee: ANSALDO ENERGIA IP UK LIMITED, London (GB)

( * ) Notice: Subject to any disclaimer, the term of this patent is extended or adjusted under 35 U.S.C. 154(b) by 621 days.

(21) Appl. No.: 14/510,562

(22) Filed: Oct. 9, 2014

(65) Prior Publication Data

US 2015/0113990 A1 Apr. 30, 2015

(30) Foreign Application Priority Data

Oct. 11, 2013 (EP) ..... 13188215

(51) Int. Cl.
*F01N 1/02* (2006.01)
*F23R 3/50* (2006.01)
*F23M 20/00* (2014.01)

(52) U.S. Cl.
CPC ..... *F01N 1/023* (2013.01); *F23M 20/005* (2015.01); *F23R 3/50* (2013.01); *F05D 2260/963* (2013.01); *F23C 2900/07002* (2013.01); *F23R 2900/00014* (2013.01)

(58) Field of Classification Search
CPC . F01N 1/023; F05D 2260/963; F23M 20/005; F23C 2900/07002; F23R 2900/00014
See application file for complete search history.

(56) References Cited

U.S. PATENT DOCUMENTS 4,106,587 A * 8/1978 Nash ..... F02K 1/827 181/213
5,333,443 A * 8/1994 Halila ..... F23R 3/002 60/752
6,546,729 B2 * 4/2003 Hellat ..... F23M 20/005 431/114
7,857,094 B2 12/2010 Macquisten et al.
8,127,546 B2 3/2012 Park
(Continued)

FOREIGN PATENT DOCUMENTS

CN 101680663 A 3/2010
CN 103189619 A 7/2013
(Continued)

OTHER PUBLICATIONS

Office Action (First Office Action) dated Jul. 28, 2017, by the State Intellectual Property Office (SIPO) of the People's Republic of China in corresponding Chinese Patent Application No. 201410530122.1, and an English Translation of the Office Action. (9 pages).

*Primary Examiner* — Carlos A Rivera
(74) *Attorney, Agent, or Firm* — Buchanan Ingersoll & Rooney, PC

(57) ABSTRACT

A Helmholtz damper for a combustor of a gas turbine includes an enclosure defining a damping volume from which a neck portion extends and which has a flow path (F) for cooling and purging air with an inlet opening and an outlet opening to the enclosure. The outlet opening is formed in the neck portion. A seal is arranged at the neck portion adjacent to the outlet opening for cooling and purging air such that a cooling effect of the seal is provided.

14 Claims, 3 Drawing Sheets

(56) References Cited

U.S. PATENT DOCUMENTS

| | | | | |
|---|---|---|---|---|
| 8,973,365 | B2 | 3/2015 | Corr et al. | |
| 2004/0211185 | A1 | 10/2004 | Young et al. | |
| 2005/0220610 | A1* | 10/2005 | Ghasripoor | F01D 5/225 415/173.3 |
| 2006/0123791 | A1* | 6/2006 | Macquisten | F23M 20/005 60/725 |
| 2008/0087019 | A1* | 4/2008 | Macquisten | F23R 3/002 60/725 |
| 2008/0106046 | A1* | 5/2008 | Datta | F16J 15/0887 277/644 |
| 2008/0295519 | A1 | 12/2008 | Park | |
| 2011/0179796 | A1* | 7/2011 | Magni | F23R 3/00 60/725 |
| 2012/0102963 | A1* | 5/2012 | Corr | F23R 3/002 60/772 |
| 2015/0020498 | A1* | 1/2015 | Schilp | F23R 3/002 60/39.83 |
| 2015/0047357 | A1* | 2/2015 | Schuermans | F23R 3/002 60/725 |

FOREIGN PATENT DOCUMENTS

| | | | |
|---|---|---|---|
| EP | 1 434 006 | A2 | 6/2004 |
| EP | 1 862 739 | A | 12/2007 |
| EP | 2 354 659 | A1 | 10/2011 |
| WO | 2012/057994 | A2 | 5/2012 |

* cited by examiner

HELMHOLTZ DAMPER FOR GAS TURBINE WITH COOLING AIR FLOW

CROSS-REFERENCE TO RELATED APPLICATIONS

This application claims priority to European application 13188215.1 filed Oct. 11, 2013, the contents of which are hereby incorporated in its entirety.

TECHNICAL FIELD

The present invention relates to the field of gas turbine technology, and in particular to damper and sealing device for a combustor or burner of a gas turbine. It relates to a device for thermoacoustic damping, as well as to a flexible annular seal utilized between concentrically assembled gas turbine combustor components.

BACKGROUND

Gas turbines are known to comprise one or more combustion chambers or combustors including several burners, wherein a fuel is injected, mixed to an airflow and combusted to generate high-pressure flue gases that are expanded in a turbine. During operation of the gas turbines, oscillations may be generated and thermoacoustic vibrations occur. This does not only lead to acoustic disturbances, but can also cause mechanical damages to the components of the gas turbine. In order to reduce the thermoacoustic vibrations during the operation of gas turbines, it is known to install in the combustion systems so-called damping devices, in particular Helmholtz dampers. Such Helmholtz dampers comprise an enclosure defining a damping volume, from which a neck portions extends and in which a flow path for cooling air is provided such that the temperatures during operation, in particular at the neck portion of the Helmholtz dampers, remain within predetermined limits. Therefore, such damping devices for combustors or burners of gas turbines require a sufficient supply of cooling air, which is guided to the neck portion of the damper.

On the other hand, such gas turbines have to be provided with sealing means between separate parts of the turbine, in particular at the interface between the burners and combustors or at other interfaces, e.g. between a combustion liner and a transition piece. For the purpose of sealing between the components of gas turbines, it is known to use circumferential metal seals. Such flexible annular seals are utilized in gas turbines for providing a sufficient sealing effect between concentrically assembled gas turbine combustor components. In order to guarantee a long lifetime and efficient sealing between the components of gas turbines, the sealings of the combustor components are conventionally equipped with means for cooling the sealing during the operation of the gas turbine. Also in order to avoid an oxidation of components, an airflow of cooling and purging air is required to be directed in particular to the tip part of such sealings of combustor components. The known sealings, e.g. hula sealings, are therefore not only complex in their design, but require also an additional supply of cooling and purging air within the gas turbine, which adds to the required airflow of cooling air necessary for the above-mentioned damping devices.

These different airflows for the purpose of the cooling of damping devices and seals can cause increased NOx emissions and may lead to problems with regard to the stability of operation of the burners and combustors. Besides the possible negative impacts on NOx and CO emissions, an insufficient cooling of the so-called Helmholtz dampers reduces also the damping efficiency during the operation of the gas turbines. In the known devices for damping and sealing, it is therefore necessary to provide respective cooling air supply means for both purposes, namely the thermoacoustic damping as well as the cooling of sealing means at the interfaces of combustor components. The design of the damping and sealing devices is therefore rather complex and leads to an increase in the overall costs of such gas turbines and has a negative impact on the operation efficiency and is disadvantageous with regard to environmental restrictions.

In view of these disadvantages, it is an object of the present invention to provide a Helmholtz damper for a combustor or burner of a gas turbine for a low-emission operation with high efficiency with regard to the thermoacoustic damping and sealing of components in the combustors. Furthermore, with the damper according to the present invention, the influence of the damping and sealing systems on the stability of operation should be reduced.

According to the present invention this problem is solved by means of a Helmholtz damper with the features of claim 1. Further developments and preferred embodiments of the invention are subject matter of the dependent claims.

The Helmholtz damper for a combustor or combustor components of a gas turbine according to the present invention comprises an enclosure defining a damping volume, from which a neck portion extends and which has a flow path for cooling and/or purging air with an inlet opening and an outlet opening to said enclosure, wherein said outlet opening is formed in the neck portion of the enclosure, and wherein the damper is characterized in that a seal is arranged at said neck portion adjacent to said outlet opening for cooling and purging air such that a cooling effect of said seal is provided. That means, the Helmholtz damper of the invention is not only specifically adapted for the purpose of thermoacoustic damping, but at the same time provides an efficient sealing means for adjacent components of the combustor interfaces. A seal is arranged at the area of the outlet opening of the cooling airflow path such that the seal is directly cooled by the cooling and purging air coming from the interior of the Helmholtz damper. By means of this, a separate supply of cooling air to the damper and the seal is avoided. This leads to a reduction of complexity in the design since no separate devices for the supply of cooling or purging air for the sealing on the one hand and for the thermoacoustic damping on the other hand are required anymore.

Furthermore, the total amount of airflow is considerably reduced, e.g. up to a half of the cooling airflow required in conventional devices for the operation of gas turbines. Also the operation of the combustors is more stable due to the reduction of mass-flow of air, and the NOx and CO emissions are hereby reduced. Nevertheless, the Helmholtz damper of the present invention has a high efficiency with regard to a limitation or elimination of vibration amplitudes during the operation of the combustor of the gas turbines, and at the same time the required sealing effect is provided. Due to the efficient cooling of both elements, namely the damper enclosure and the seal, the operation range of the gas turbine equipped with such a Helmholtz damper is large. Due to the constant air temperatures at particularly the neck portion of the enclosure of the damper as well as the seal arranged in the airflow of the cooling air, a stable operation and a long lifetime of the components are given.

According to an advantageous aspect of the invention, the Helmholtz damper is characterized by a common supply of cooling and purging air for the damper and the seal. The damper and the seal, which is provided at the neck portion of the Helmholtz damper, hereby share one single supply means for cooling air. The means for supplying cooling and purging air is, for example, attached to the inlet opening of the enclosure of the Helmholtz damper. The cooling airflow coming from the inlet opening passes through the inside of the enclosure and the neck portion of the damper, providing the required cooling effect of the damper for eliminating the thermoacoustic oscillations, and flows afterwards directly to the seal in the area of the outlet opening, the seal thus being cooled by one and the same cooling and purging airflow. By sharing a common supply of cooling and purging air in the Helmholtz damper, separate means for generating and providing cooling air are not necessary for the two components, i.e. the seal and the damping element. This results in an overall considerably reduced air consumption and therefore also in reduced costs and in a more stable operation of the gas turbine, since the added cooling air in the combustion chambers is reduced as compared to combustion systems with separate means for providing cooling air to the seal and the damping devices.

According to an advantageous aspect of the Helmholtz damper of the present invention, the seal is an integrated part of said neck portion of the enclosure of the damper. By means of this, the seal is a part of the Helmholtz damper itself, or it is firmly attached to the neck portion of the enclosure. This facilitates the installation of the damping and sealing system in a combustion system of a gas turbine. For example, it is not required to provide separate attachment means for the seal and the damping device, as was the case in the prior art. Furthermore, with the seal as an integrated part at the neck portion of the Helmholtz damper, the cooling of the seal is enhanced: the neck portion already cooled by the cooling airflow transmits the cooler temperature directly to the sealing part, which is an integrated part of the neck portion of the damper.

According to a further advantageous aspect of the Helmholtz damper according to the invention, the neck portion of the enclosure of the damper has an extended length for the accommodation of said seal and/or fastening means for fastening the damper within a combustion system of a gas turbine. The length of the neck portion is extended in view of conventional Helmholtz dampers of the prior art, in which a rather short neck portion is usually given. With the extended neck portion, the fastening of the Helmholtz damper to the interfaces of a combustion chamber is facilitated. Furthermore, with the extended length, the neck portion is specially adapted for the arrangement of a seal in this area where the cooling airflow exits from the enclosure of the Helmholtz damper. For example, the attachment means for mounting the damper to a transition wall or to an interface in the combustion chambers is provided at one side of the neck portion, whereas the seal is mounted or provided at the opposite side of the neck portion. The complete Helmholtz damper is hereby fixedly attached to the interface or wall of the combustor, so that the damping effect is guaranteed. The seal, which is on the other side of the neck portion, can undergo sufficiently large displacements in an elastic range without losing its sealing efficiency. By means of these measures, a combined efficient thermoacoustic damping and sealing is realized by means of one and the same Helmholtz damper device.

According to a further advantageous aspect of the Helmholtz damper of the invention, the outlet opening for the cooling and purging airflow is provided with flow guiding means directed to said seal at the neck portion of the enclosure. A concentrated stream of cooling airflow is hereby directed to the seal, which is arranged in the area of the outlet opening of the Helmholtz damper in said neck portion. An increased cooling effect of the seal is hereby achieved. The seal and the neck portion of the Helmholtz damper are thereby protected from hot combustion gases flowing in the adjacent combustion areas of a combustor or a burner of a gas turbine. By means of such flow guide elements, which can, for example, be given in the form of airflow guide blades, specific flow patterns can be created in the area of the seal and the neck portion of the Helmholtz damper, so that the cooling effect during the operation of the gas turbine can be adapted to respective designs of combustion chambers or gas turbines and the flow paths of hot gases.

According to a further advantageous aspect of the Helmholtz damper according to the invention, the neck portion of the enclosure is provided with fastening means to an interface of a combustion chamber. The interface can, for example, be a liner-front-panel interface or a liner-carrier interface in a premix combustor or in a so-called SEV combustor. Furthermore, the fastening means at the neck portion can be adapted for a mounting of the combined damper and sealing device according to the invention on a front panel of a burner between a liner or further components of a gas turbine. Examples of fastening means are rectilinear wall portions for screws or welding in the sense of mounting flanges. Other types of fastening means may also be provided.

According to a further advantageous aspect of the Helmholtz damper of the invention, the seal is arranged on a circumferential outer side with regard to said enclosure of the damper. That means, the damper is in a more radial inner position as compared to the seal, which is at a radial outer position with regard to the enclosure forming the damping body. According to an alternative embodiment of the invention, the seal is arranged on a circumferential inner side with regard to the enclosure of the Helmholtz damper. Depending on the respective local hot gas flow pattern in the combustion system of the gas turbines, it might be beneficial to place the seal radially inside or outside of the damper. By means of the modification of the position of the seal with regard to the enclosure of the Helmholtz damper, the sealing and damping efficiency of the device can be further increased. For example, the outlet opening and neck portion of the enclosure can be realized in a lateral position of the enclosure, and the seal on the neck portion is either provided on the radial inner side or on the radial outer side of this laterally offset neck portion. With such a form of damper/seal combination, the Helmholtz damper of the invention can be adapted to respective flow patterns of hot combustion gases and/or to the respective free spaces within the combustor system of a gas turbine. By means of these measures, the damper of the invention is specially adapted also for a mounting as a retrofit part, or it is well adapted for a later integration in burners or combustors as a retractable design.

According to a further advantageous aspect of the Helmholtz damper of the invention, the seal is segmented along a sealing surface. With a segmented seal, the transfer of heat from one part of the seal to the other parts is reduced. Furthermore, the segmented form allows a certain displacement of the segments of the seal in lateral directions due to a shrinking or deformation of components of the gas turbine. In an alternative form of realization, the seal is realized as a single piece, e.g. made of appropriate spring steel materials or the like.

According to a further advantageous aspect of the Helmholtz damper of the invention, the seal is a spring-type seal, and it is in particular a hula seal or an E-seal. With a spring-type seal, large displacements in an elastic range of the components of the turbine can be accommodated without loosing the required sealing efficiency of the seal part of the Helmholtz damper. An E-seal provides a seal, which is designed for low or moderate force conditions and high spring-back for achieving the large displacements required in some applications of combustion systems of gas turbines. A so-called hula seal is generally defined as a system of leaf springs formed into a round loop, which is used to seal a sliding interface joint or annular gap between two concentric elements, e.g. at an interface between a burner or combustor of a gas turbine. Both types of seal have been shown to be especially well adapted for an integration in combination with the Helmholtz damper as it is the subject matter of the present invention.

According to a further advantageous aspect of the Helmholtz damper of the invention, the enclosure of the damper is a single volume device. With the enclosure as a single volume device, the Helmholtz damper is specifically adapted for low-frequency pulsations and vibrations. Depending on the expected or actual form of frequencies and pressure oscillations in a combustion system of a gas turbine, the Helmholtz damper can be used accordingly.

According to an alternative form of realization of the invention, the Helmholtz damper is provided with an enclosure, which is a segmented volume device. A segmented volume device is well adapted for providing an efficient damping in case of high-frequency pulsations. In both cases, a segmented volume device and a single volume device, in particular the neck portion of the enclosure is cooled by a cooling airflow coming from an inlet opening and passing through the neck portion to an outlet opening. The temperature range of the enclosure of the Helmholtz damper remains in a predefined temperature range, so that no considerable modification of the damping function is created during the operation of the gas turbine. A more predictable and more efficient thermoacoustic damping is hereby achieved.

According to a further advantageous aspect of the invention, the enclosure of the Helmholtz damper is designed for varying the damper volume. The Helmholtz damper of the invention is provided with an adjustable volume for the purpose of damping different ranges of frequencies or vibrations. A more flexible use in a broader range of applications is hereby given. The volume of the enclosure may, for example, be modified by means of varying the segment size of the enclosure, the neck length of the neck portion of the enclosure, and/or the size of the outlet opening at the neck portion. For a skilled person in the art, there are further possibilities of adjusting the damping volume of such enclosures of Helmholtz dampers. With such changes and modifications of the damping volume, the efficiency with regard to the damping is furthermore increased, while at the same time the damper according to the invention provides an excellent sealing effect.

According to a further advantageous aspect of the invention, the Helmholtz damper is designed as a retrofit part for mounting in existing burners or combustors of gas turbines. A broader range of installation possibilities for the combined damping and sealing device of the Helmholtz damper of the present invention is hereby given. The Helmholtz damper can easily be integrated into existing designs and combustion systems of gas turbines. The damper can, for example, also be installed in such areas of interfaces between the combustors and burners of a combustion system, in which the conventional separate sealing devices and damping devices with respective separate cooling means have previously used. Such a form of a Helmholtz damper can also be realized as an independent device, which can regularly be inspected and, if necessary, replaced in a gas turbine. The maintenance is hereby made easier, and the operation safety margin is higher.

BRIEF DESCRIPTION OF THE DRAWINGS

In the following, the present invention will be described in more detail with regard to some embodiments or examples of realization of the invention, with reference to the attached drawings, in which.

DESCRIPTION

Figure 1:
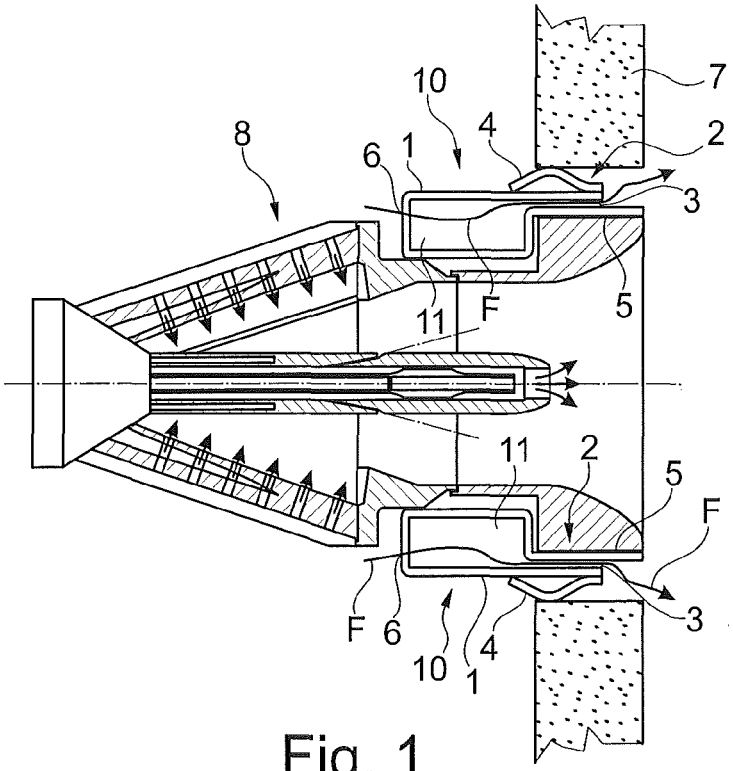
FIG. 1 is a schematic cross-section view of a first embodiment of a Helmholtz damper according to the invention and applied to a premix burner.

In FIG. 1, a first embodiment of a Helmholtz damper 10 according to the invention is shown in a schematic cross-section view in application to a premix burner 8 of a combustion system of a gas turbine. The Helmholtz damper 10 is mounted to an interface between a premix burner 8 and a front panel 7 of a combustor of the gas turbine. For providing the required damping effect in view of thermoacoustic vibrations during the operation of the gas turbine, the Helmholtz damper 10 has an enclosure 1 defining a rectangular damper volume 11 at a lateral outer side of the premix burner 8 in respective indentations. The enclosure 1 of the damper 10 is furthermore provided with a neck portion 2 of an elongated form. With the elongated neck portion 2, the Helmholtz damper 10 is mounted at the interface between the premix burner 8 and the front panel 7. For this purpose, fastening means 5 are provided at the radial inner side of the neck portion 2 in the form of a rectilinear wall portion like a flange adapted for mounting to the outer side of the premix burner 8. A flow path F for cooling and purging air is provided, passing through the damper volume 11 and the neck portion 5 from an inlet opening 6 to an outlet opening 3. The latter is included in the neck portion 2 of the damper 10. In this embodiment, the outlet opening 3 is formed by the free end of the tube-like neck portion 2. With this flow path F of cooling and purging air, the Helmholtz damper 10 is cooled in order to maintain the required temperatures for a stable operation and for achieving the required damping effect even in case of varying pressure oscillations during the operation of the gas turbine. The airflow F of cooling and purging air is in particular required for cooling the neck portion 2 of the Helmholtz damper 10, which is arranged more closely to the hot gas of the combustion chamber.

According to the present invention, the Helmholtz damper 10 has furthermore at the neck portion 2 a seal 4. The seal 4 in this example of realization is arranged at the radial outer side of the neck portion 2 and contacts the front panel 7 for providing the required sealing effect. The seal 4 at the neck portion 2 is in such a position that the cooling and purging air of the flow path F coming from the outlet opening 3 passes around or along the seal 4 and in particular the front end of the seal 4 facing to the inner side of the combustion system, i.e. to the hot gases of the combustor of the gas turbine. Through this specific arrangement and positioning of the seal 4 of the Helmholtz damper 10 with regard to the outlet opening 3 for the flow path F of the cooling and purging air, an efficient and simultaneous cooling of the seal 4 as well as the enclosure 1 of the Helmholtz damper 10 is achieved. The neck portion 2 is formed with a sufficient length in order to arrange the seal 4 at the radial outer side of the enclosure 1. The front end of the neck portion 2 forms the outlet opening 3 for the flow path F of the cooling and purging air, which is supplied from a common cooling air supply means for the damper 10 and the seal 4. By means of this arrangement and positioning of the seal 4 with regard to the outlet opening 3 of the enclosure 1, the same airflow F is used for the purpose of cooling the damper 10 and in particular the neck portion 2 of the damper 10 as well as the seal 4. According to the invention, it is therefore not required to provide separate cooling means for the purpose of the efficient sealing as well as the providing of a damping effect of the Helmholtz damper 10. The amount of required cooling air is therefore considerably reduced, i.e. up to half of the amount of cooling air necessary for such conventional damping and sealing means in gas turbines.

Hereby, also the complexity of the construction and design of the sealing/damping means is reduced. With the invention, the overall costs of the sealing and damping means for such combustor systems of gas turbines are therefore also reduced. The seal 4 may be an integrated part of the neck portion 2 of the Helmholtz damper 10, or may be attached to the neck portion 2 by any appropriate means of attachment, e.g. welding, screw means, etc. The seal 4 in the form of realization shown in FIG. 1 is a spring-type seal, e.g. a so-called hula seal, for enabling sufficiently large displacements in an elastic range. Between the premix burner 8 and the front panel 7, the seal has several leaf springs formed in a semi-circle loop facing to the radial outer side of the Helmholtz damper 10. Other types of seals 4 may also be used for the sealing effect of the Helmholtz damper 10 according to the invention. Also, alternative positions of the arrangement of the seal 4 are possible, as long as the seal 4 is in such a position that the airflow F of cooling and purging air coming from the inside of the Helmholtz damper 10 passes over at least a portion of the seal 4, e.g. the seal front portion, in order to provide the necessary cooling effect of the seal in combination with the cooling of the enclosure 1 and neck portion 2 of the damper 10. With this specific design of the Helmholtz damper 10 according to the invention, an efficient sealing and damping function is guaranteed in one and the same device. Since the amount of required cooling air is considerably reduced, the operation stability of the gas turbine is also given. With the comparatively low amount of cooling airflow, which is mixed with the gas in the combustion chamber, also the NOx and CO emissions are lower as compared to conventional damping and sealing devices for gas turbines.

Possible implementations for the Helmholtz damper 10 with a combined sealing and damping function are in particular the interfaces between burners and combustors and associated parts of a gas turbine. For example, the damper 10 according to the present invention can be applied to interfaces of EV burners (Environmental Vortex burners), AEV burners, BEV burners and SEV burners (Sequential Environmental Vortex burners). Nevertheless, it is to be noted that the application possibilities of the Helmholtz damper of the invention are not limited to these types of combustor or burner, and the invention can be applied to other interfaces in gas turbines, such as a liner-front-panel interface or a liner-carrier interface of a sequential combustion system of a gas turbine. In any of these implementations, a sealing as well as a damping of thermoacoustic vibrations is required, and by the Helmholtz damper 10 of the invention, these two functions are efficiently provided with a less complex form of design and with a considerably reduced amount of required cooling and purging air.

Figure 2:
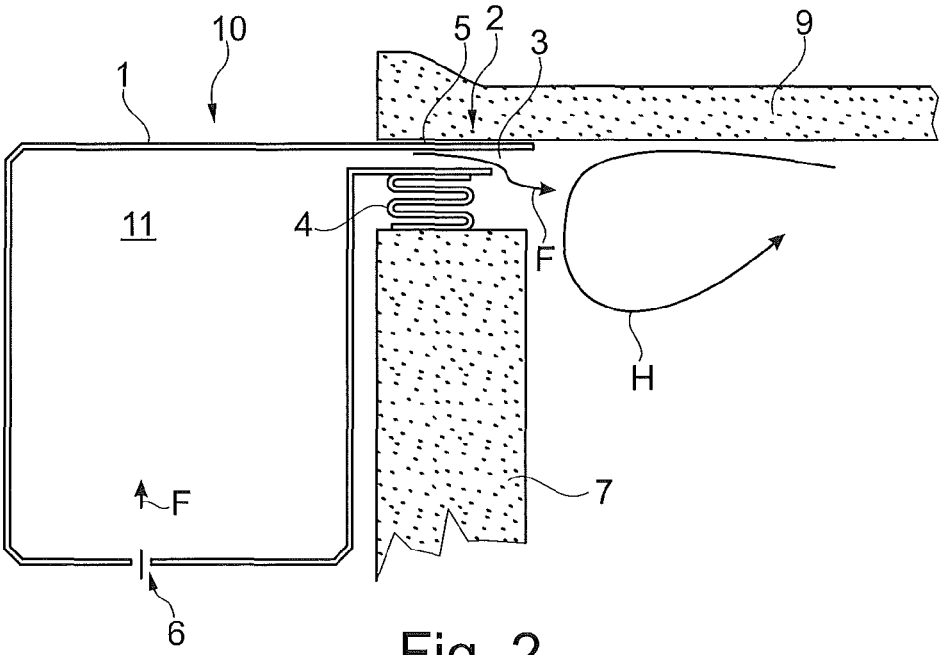
FIG. 2 is a schematic cross-section view of a second embodiment of a Helmholtz damper according to the invention with an alternative form of a seal.

A second example of realization is shown in a schematic cross-section view of FIG. 2. Also in case of this second example of realization, the Helmholtz damper 10 of the invention is provided with an essentially rectangular enclosure 1 forming a damping volume 11, through which an airflow F of purging and cooling air is guided. The cooling air enters at the inlet opening 6 provided at a lateral wall of the enclosure 1, passes through the interior of the damping volume 11 and flows out from an outlet opening 3, which is the front opening of a neck portion 2 of the Helmholtz damper 10. Cooling air coming from the outlet opening 3 passes around the front part of a seal 4, which is provided for the sealing of the combustor chamber, and prevents the increase in temperature due to a flow of hot gas H in the combustor. The neck portion 2 is provided with an elongated form such that fastening means 3 as well as a seal 4 may be incorporated into the Helmholtz damper 10 at this neck portion 2. Contrary to the first embodiment described with reference to FIG. 1, this second embodiment according to FIG. 2 has a seal 4 on the radial inner side of the damper 10 and the related combustor system or gas turbine. The attachment means 3 is formed at the radial outer side of the Helmholtz damper 10 in form of a rectilinear wall of the neck portion 2, by means of which the damper 10 is fixedly attached to a liner 9 of the gas turbine. On the radial inner side, the neck portion 2 is provided with a seal 4, which is in this example of realization an E-type seal. By interposing the seal 4 between the radial inner side of the neck portion and a burner front panel 7, a tight sealing of the interior of the combustor chamber, in which the hot combustor gases H flow, as schematically indicated by the arrow H in FIG. 2, is provided. Also here, the cooling airflow F coming from the inlet opening 6 and passing through the neck portion 2 in order to flow out of the outlet opening 3, passes along a lateral front surface of the seal 4 such that the seal 4 is cooled by one and the same cooling airflow F as compared to the cooling of the Helmholtz damper 10 itself.

At the outlet opening 3, there may be provided flow guiding means (not shown in FIG. 2) for directing the flow F of cooling and purging air from the direction of the longitudinal axis of the neck portion 2 specifically to the seal 4, which is arranged in this embodiment laterally at a radial inner side of the neck portion 2. With this measure, the cooling effect is even more increased. Also in this form of realization of the Helmholtz damper 10 of the invention, the seal 4 and the enclosure 1 are provided with one and the same common cooling air supply. The supply of cooling air coming from the inlet opening 6 may be formed by any conventional airflow generation means, which is known to the person skilled in the art. For example, the cooling air can be bypass air coming from a compressor of the gas turbine, or can be separate cooling air coming from the outside of the gas turbine. With this design of a Helmholtz damper 10 according to the invention, the seal is shielded by the stream of cooling air coming from the outlet opening 3, without separate cooling means being required for the achievement of an efficient sealing effect.

The Helmholtz damper 10 of the invention is so to speak a combination of both functions in a very efficient and compact manner, namely the damping effect as well as the cooling of the sealing means. Not only is the amount of required cooling and purging air reduced by the invention, but also the overall costs of the sealing and damping devices are less compared to conventional gas turbines due to the common parts and synergies achieved by this form of design of a Helmholtz damper 10. According to an advantageous aspect of the invention, the Helmholtz damper 10 is formed as an independent device, which can easily be maintained and, if necessary, replaced. However, the present invention is not limited to such a form of realization, and the Helmholtz damper 10 may also be an integrated part of other components of the gas turbine. Also with regard to the specific form of the enclosure 1 and the position of the seal 4 with relation to the enclosure 1, the invention is not limited to the shown forms of realization. For example, the neck portion 2 can be at a middle position of the enclosure 1 instead of a lateral position as shown in the embodiments of FIG. 1 and FIG. 2. Also the inlet opening 6 and the position of the outlet opening 3 may be modified within the scope of the present invention.

Figure 3:
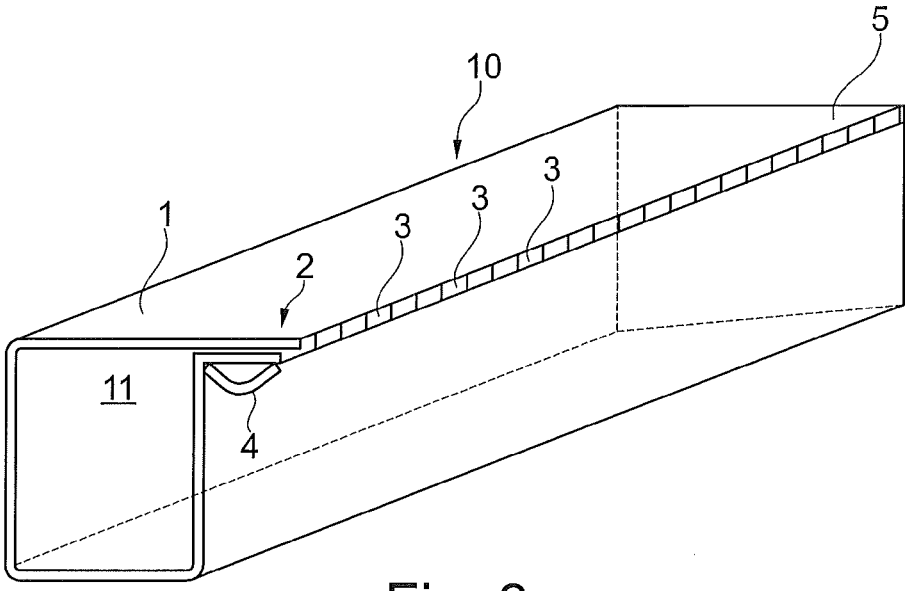
FIG. 3 is a schematic perspective view of a third embodiment of a Helmholtz damper according to the invention, having a single damping volume.
Figure 4:
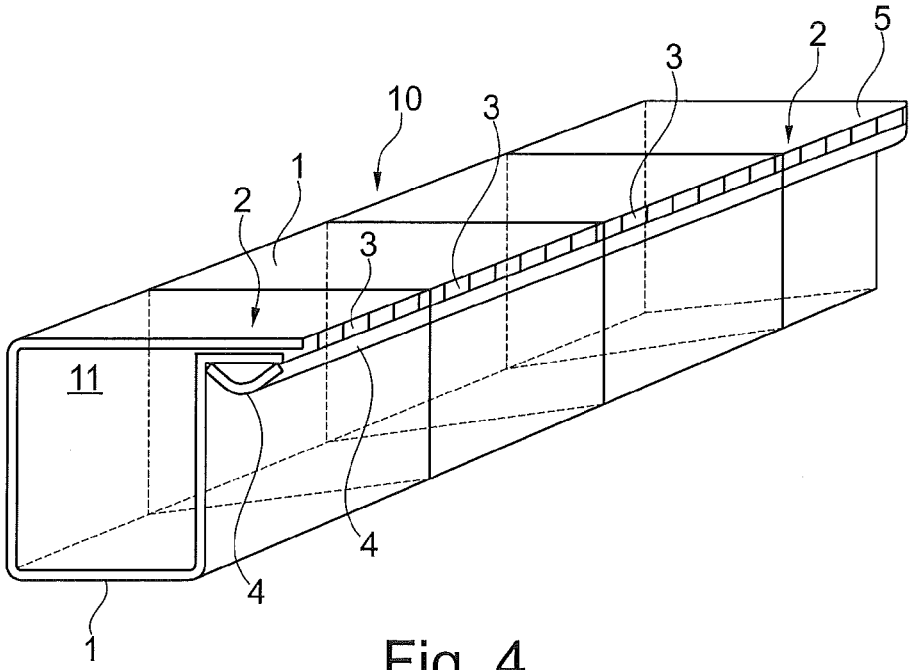
FIG. 4 is a schematic perspective view of a fourth embodiment of a Helmholtz damper according to the invention, having a segmented damping volume.

FIG. 3 and FIG. 4 show in perspective schematic views two different further examples of realization of a Helmholtz damper 10 according to the present invention: it is to be noted that the damper 10 shown in FIG. 3 and FIG. 4 in only schematic views is usually not a rectilinear damper 10, but has an overall annular form for the mounting on a circumferential outer side of a circular component of a combustor system of a gas turbine. Also here, the damper 10 has an enclosure 1 forming a damping volume 11 in an essentially rectilinear or square cross-section form. The enclosure 1 is formed on a lateral upper side with a neck portion 2, in which several outlet openings 3 are provided for the airflow of cooling and purging air coming from an inlet opening (not shown in FIG. 3 and FIG. 4). In the neck portion 2, the radial outer side (upper side in FIG. 3 and FIG. 4) is formed as a flat wall portion, which serves as fastening means 5 for the secure mounting of the damper 10 within a combustor system of a gas turbine. On the opposite side of the neck portion 2, there is also provided a seal 4, which in this case is a spring-type seal, e.g. a hula seal as in the case of the first embodiment of FIG. 1. Contrary to the first embodiment of FIG. 1, the seal 4 in this embodiment of FIG. 3 and FIG. 4 is formed at a radial inner side of the neck portion 2. Depending on the specific flows of hot gases in the combustion systems, the seal 4 on the neck portion 2 of the damper 10 may be in a radial outer position or inner position, as it is required.

According to the embodiment shown in a schematic view of FIG. 3, the enclosure 1 is a single volume forming a single damping volume 11. Such a form of realization is specifically adapted to a damping of low frequency pulsations. On the other hand, the example of realization according to FIG. 4 is formed with several inner partition walls within the damper volume 11, i.e. the interior of the enclosure 1, such that a segmented damping volume is created. Such a form of realization of the Helmholtz damper 10 of the invention is in particular adapted for vibrations of high frequency. By means of such a modification of the inner form of the enclosure 1, the Helmholtz damper 10 can be adapted to different types of applications and operation situations of gas turbines and combustor interfaces. Besides this example of a possible modification of the Helmholtz damper 10 in view of the range of frequencies, to which it is adapted for its damping effect, the damper 10 can also be modified by other means: for example, the damper volume itself, the neck length and the area of the outlet opening, and the form of the enclosure 1 can be modified in order to make the Helmholtz damper 10 suitable for different frequencies or to make it flexible for a damping of multiple frequencies. The Helmholtz damper 10 according to the invention is in particular designed as a retrofit part, which can also be installed into existing combustion systems of gas turbines. For the purpose of a mounting and the integration within the open spaces and areas of such combustion systems, the Helmholtz damper 10 of the invention can also be designed in a retractable form of construction.

Figure 5:
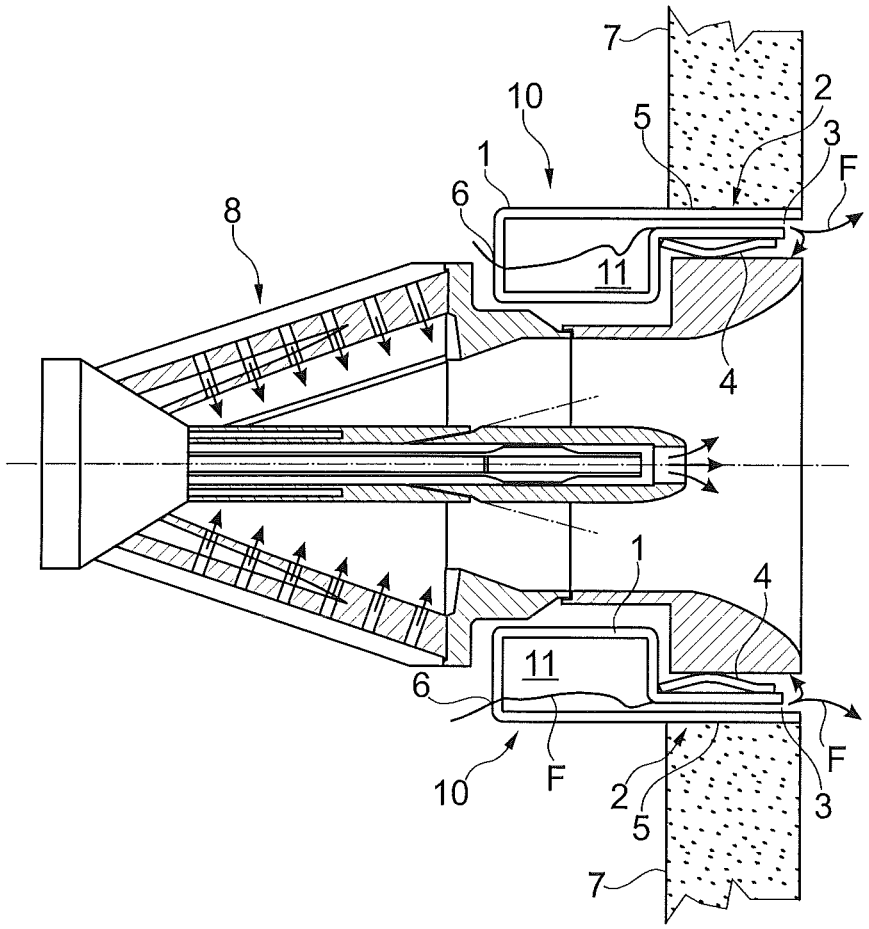
FIG. 5 is a schematic cross-section view of a fifth embodiment of a Helmholtz damper according to the invention with an alternative positioning of the seal.

Finally, in FIG. 5, a fifth embodiment of a Helmholtz damper 10 for a combustor of a gas turbine according to the present invention is shown in a schematic cross-section view. Also in this example of realization, the Helmholtz damper 10 is applied to a premix burner 8 and is attached to a front panel 7 of a combustor chamber or burner by means of fastening means 5 in the form of an elongated rectilinear wall in a neck portion 2 of the enclosure 1 of the Helmholtz damper 10. The enclosure 1 forms a damping volume 11 in a rectilinear cross-section form, in which an inlet opening 6 as well as an outlet opening 3 for cooling and purging air are provided. The arrow F in FIG. 5 represents an airflow path for this cooling and purging air, which comes from a common supply of cooling air (not shown in FIG. 5) for the purpose of cooling the damper 10 as well as a seal 4. In this form of realization according to FIG. 5, the seal 4 is in a radial inner position with regard to the rotational axis of the gas turbine. Also in this form of realization, the seal 4 may be a spring-type seal, such as a hula seal or an E-seal, which is characterized by a large possibility of displacement between the respective turbine components, i.e. in this case the premix burner 8 and the front panel 7 of the burner. The seal 4 is cooled by the cooling and purging air coming from the outlet opening 3, so that the cooling airflow F forms a kind of shield for protecting the seal 4 from the high temperatures of hot gases within the adjacent combustion chamber of the gas turbine. This means also in this case of the form of realization according to FIG. 5 a common cooling airflow F is used for the cooling of in particular a neck portion 2 of the Helmholtz damper 10 as well as the seal 4, which is arranged in an area close to the outlet opening 3 of the neck portion 2. With this form of realization, the required mass flow of cooling air is considerably reduced, since both elements, i.e. the seal element and the damper element, are cooled by one and the same cooling airflow F. The two basic elements use the same device for supplying cooling air, so that the damper/sealing device is less complex in view of its construction. The overall costs are therefore also limited.

The Helmholtz damper 10 according to the present invention may have a different form with regard to the enclosure 1, e.g. an elongated form or a more compressed form, depending on the respective designs of gas turbines. Also the type of seal used at the area of the neck portion of the Helmholtz damper 10 of the invention can be different from the examples shown in the above description. Also the position of the inlet opening 6 and the outlet opening 3 may be different as compared to the above-described examples of realization. Provided that one and the same cooling and purging airflow F is used for the cooling of both the damper 10 and the seal 4, the invention may be realized in a broad variety of possible designs without departing from the scope of protection of the attached claims.

The invention claimed is:

1. A Helmholtz damper for a combustor of a gas turbine comprising;

an enclosure defining a damping volume from which a neck portion extends in a longitudinal direction, said enclosure having an inlet opening and an outlet opening, wherein said damping volume has a flow path (F) from said inlet opening to said outlet opening of said enclosure for cooling and purging air, wherein said neck portion is defined by two annular surfaces having different longitudinal lengths with said outlet opening formed between said annular surfaces, and wherein a seal is arranged at said neck portion adjacent to said shorter annular surface of the outlet opening such that cooling and purging air establishes a cooling effect at an end of said seal.

2. The Helmholtz damper according to claim 1, further comprising a common supply of cooling and purging air for the damper and said seal.

3. The Helmholtz damper according to claim 1, wherein said seal is an integrated part of said neck portion.

4. The Helmholtz damper according to claim 1, wherein said neck portion has an extended length for the accommodation of said seal and/or fastening means.

5. The Helmholtz damper according to claim 1, wherein said neck portion is provided with fastening means to an interface of a combustor chamber.

6. The Helmholtz damper according to claim 1, wherein said seal is arranged on a radial outer side with regard to said enclosure of the damper.

7. The Helmholtz damper according to claim 1, wherein said seal is arranged on a radial inner side with regard to said enclosure of the damper.

8. The Helmholtz damper according to claim 1, wherein said seal is segmented along a sealing surface.

9. The Helmholtz damper according to claim 1, wherein said seal is a spring type seal.

10. The Helmholtz damper according to claim 1, wherein said enclosure is a single volume device.

11. The Helmholtz damper according to claim 1, wherein said enclosure is a segmented volume device.

12. The Helmholtz damper according to claim 11, wherein each segment within said segmented volume device has a different size and establishes a varying damper volume.

13. The Helmholtz damper according to claim 1, wherein the damper is designed as a retrofit part for mounting in existing burners or combustors of gas turbines.

14. The Helmholtz damper according to claim 9, wherein the spring-type seal is a hula-seal or an E-seal.

* * * * *